United States Patent [19]

Nakata et al.

[11] Patent Number: 4,552,590

[45] Date of Patent: Nov. 12, 1985

[54] FERRO-SINTERED ALLOYS

[75] Inventors: Tohru Nakata, Matsudo; Hiroyuki Endo, Abiko; Masatoshi Harada; Tadao Hayasaka, both of Kashiwa; Osamu Miyamoto, Matsudo, all of Japan

[73] Assignee: Hitachi Powdered Metals Co. Ltd., Japan

[21] Appl. No.: 522,663

[22] Filed: Aug. 12, 1983

Related U.S. Application Data

[62] Division of Ser. No. 237,906, Feb. 25, 1981, Pat. No. 4,422,875.

[30] Foreign Application Priority Data

Apr. 25, 1980 [JP] Japan ..... 55-54316
May 9, 1980 [JP] Japan ..... 55-60609

[51] Int. Cl.[4] ..... B22F 5/00; C22C 38/00

[52] U.S. Cl. ..... 75/246; 428/567; 428/569

[58] Field of Search ..... 428/567, 568, 569; 419/27, 11; 75/243, 246

[56] References Cited

U.S. PATENT DOCUMENTS 3,812,565 5/1974 Seino et al. ..... 419/27
3,827,863 8/1974 Takahashi et al. ..... 75/243
3,837,816 9/1974 Takahashi et al. ..... 75/237
3,863,318 2/1975 Niimi et al. ..... 75/243
3,982,905 9/1976 Osawa et al. ..... 75/243
4,080,205 3/1978 Niimi et al. ..... 75/241
4,204,031 5/1980 Takamura et al. ..... 75/246

FOREIGN PATENT DOCUMENTS 73852 3/1980 Japan .

*Primary Examiner*—Edward A. Miller
*Assistant Examiner*—Anne Brooks
*Attorney, Agent, or Firm*—McGlew and Tuttle

[57] ABSTRACT

A ferro-sintered alloy having wear resistance at elevated temperatures comprising a matrix in which, on a weight basis, 25–75% of an alloying base A of the following composition is irregularly dispersed with 75–25% of an alloying base B of the following composition, the matrix having dispersed therein 3–15% of at least one of the following hard phases C and D, and optionally being impregnated in its pores with lead:

| Base A | | Base B | |
|---|---|---|---|
| Cr | 2–4% | Co | 5.5–7.5% |
| Mo | 0.2–0.4% | Ni | 0.5–3% |
| V | 0.2–0.4% | Mo | 0.5–3% |
| C | 0.6–1.2% | C | 0.6%–1.2% |
| Fe | the remainder | Fe | the remainder |

Hard phase C: 45–60% Co - 33–36% Mo. - and remainder Si
Hard phase D: 45–60% Fe - 33–36% Mo - and remainder Si.

2 Claims, 7 Drawing Figures

(x225)

(x340)

FERRO-SINTERED ALLOYS

This is a division of application Ser. No. 237,906 filed Feb. 25, 1981, now U.S. Pat. No. 4422875.

BACKGROUND OF THE INVENTION

The present invention relates generally to a ferro-sintered alloy exceling in wear resistance at elevated temperatures, and more particularly to a ferro-sintered alloy suitable for use in valve seats of internal combustion engines.

The valve seats for internal combustion engines have heretofore been formed of specialty cast iron or heatresistant steel. In the meantime, a series of drastic exhaust gas regulations have been laid down and enforced for the protection of environment and many improvements have been introduced in the fuel cost and performance of internal combustion engines, correspondingly. As a matter of fact, rigorous requirements have increasingly been imposed upon the use of valve seats. The situation being like this, various materials developed to meet an early stage of regulations can no longer be employed, to say nothing of the aforesaid materials.

During the operation of an internal combustion engine, the valve seats are exposed to high-temperature combustion gases and receive a continuity of impacts from the valves that rotate slowly but reciprocate at high speeds. Accordingly, the valve seat materials have to display excellent wear resistance under such conditions.

In view of the sliding wearing of certain types that the valve seat suffers, the hardness of the materials applied is considered of great importance in the improvement of wear resistance. However, the use of the materials having a greater hardness with a view to preferentially improving the wear resistance gives rise to difficulties in the production, since parts such as valve seats inevitably require mechanical working.

Japanese patent application No. 144325/53 discloses a sintered steel material comprising 25 to 75 weight % of an alloying base A consisting of the following components and 75 to 25 weight % of an alloying base B consisting of the following components, said bases A and B being dispersed in spots.

| Base A | Base B |
|---|---|
| Cr 2~4% (by weight) | Co 5.5~7.5% (by weight) |
| Mo 0.2~0.4% (by weight) | Ni 0.5~3% (by weight) |
| V 0.2~0.4% (by weight) | Mo 0.5~3% (by weight) |
| C 0.6~1.2% (by weight) | C 0.6~1.2% (by weight) |
| Fe the remainder | Fe the remainder |

Although this material has excellent wear resistance over the prior art materials, it is found that unusual wearing sometimes takes place under the present severe conditions; hence, there is left much to desired, in particular as to wear resistance.

SUMMARY OF THE INVENTION

A main object of the present invention is to provide a ferro-sintered alloy which meets the aforesaid requirements.

According to the first aspect of the present invention, there is provided a ferro-sintered alloy having wear resistance at elevated temperatures, comprising a matrix in which 25 to 75 weight % of an alloying base A of the following composition is irregularly dispersed with 75 to 25 weight % of an alloying base B of the following composition, said matrix having 3 to 15 weight % of at least one of the following hard phases C and D dispersed therein:

| Base A | Base B |
|---|---|
| Cr 2~4% (by weight) | Co 5.5~7.5% (by weight) |
| Mo 0.2~0.4% (by weight) | Ni 0.5~3% (by weight) |
| V 0.2~0.4% (by weight) | Mo 0.5~3% (by weight) |
| C 0.6~1.2% (by weight) | C 0.6~1.2% (by weight) |
| Fe the remainder | Fe the remainder |
| Hard phase C: 45~60% Co—33~36% Mo—Si Alloy (by weight) | |
| Hard phase D: 45~60% Fe—33~36% Mo—Si Alloy (by weight) | |

According to the second aspect to the present invention, there is provided a ferro-sintered alloy having wear resistance at elevated temperatures, comprising a perlite matrix having a copper content of 0.2 to 1.5 weight %, in which are dispersed 10 to 50 weight % of a phase A rich in heat- and corrosion-resistance and having the following composition and 2 to 15 weight % of at least one selected from the group consisting of four phases B rich in wear resistance and having the following composition:

| | |
|---|---|
| Phase A | Cr 9~20% (by weight)<br>Ni 6~15% (by weight)<br>Mo 1.5~9.5% (by weight)<br>W 1.5~9.5% (by weight)<br>Cu 0.7~4.5% (by weight)<br>Fe the remainder |
| Phase B | 50~70% Mo—Fe Alloy<br>50~70% Cr—Fe Alloy<br>45~60% Fe—33~36% Mo—Si Alloy<br>45~60% Co—33~36% Mo—Si Alloy |

DETAILED DESCRIPTION OF THE INVENTION

The present invention will now be explained in detail with reference to the first and second aspects of the present invention in conjunction with the accompanying drawings in which:

FIG. 1 is a graphical view illustrative of the relationship between the wearing rate and the abrasion of samples having a different content of the hard phase(s);

FIG. 2 is a graphical view illustrative of the relationship between the hard phase content, the abrasion and the radial crushing strength;

FIG. 3 is a graphical view indicative of the results of bench durability testing;

FIG. 4 is a graphical view and a micrograph showing an influence of the sintering temperature upon the wear resistance, radial crushing strength and metallic structure of the sintered material according to the present invention:

To obtain an improved degree of wear resistance, it is effective to disperse hard substances in a matrix. As a consequence of extensive investigations carried out on the wear resistance of various materials comprising a variety of matrixes and ternary intermetallic compounds of Co-Mo-Si and Fe-Mo-Si added thereto as the hard substances, it has been found that a marked effect is obtained particularly when 3 to 15 weight % of the hard substances are added to the alloy of the aforesaid Japanese patent application.

It has also been found that the alloy according to this aspect is only worn to a normal degree even under the testing conditions where a valve seat made of the prior art alloy suffers an excessive wearing using an actual engine mounted on a bench. This aspect of the present invention will now be elucidated with reference to the following example.

EXAMPLE

In this example, % is given in weight.

Figure 1:
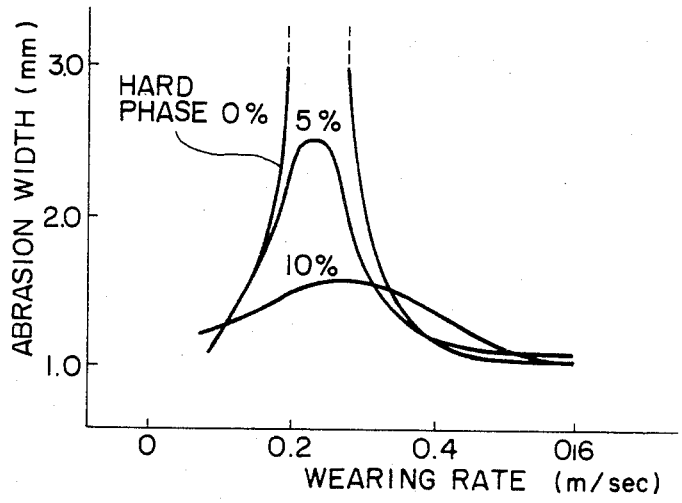
FIGS. 1 to 4 are concerned with the first aspect and FIGS. 5 to 7 concerned with the second aspect.

The alloying bases A and B free from carbon, in the powdery form, were first mixed with graphite powders such that both bases had a rate of 1 to 1, and then added with the powdery hard phase C having a composition of Co-35% Mo-10% and remainder Si, at different amounts of the hard phase C up to 20%. The resulting mixtures were formed into desired shapes and sintered at 1200° C. for 20 minutes in a protective atmosphere, thereby to prepare several test samples containing different amounts of the hard phase C. These samples were subjected to abrasion testing on an Okoshi-type abrasion tester. Of the obtained data, those of the samples containing 0, 5 and 10% of the hard phase C are given in FIG. 1. From this graph, it is found that there is a region where the greatest degree of wearing is observed; and that the addition of the hard phase markedly ameliorates the degree of wearing even under such adverse conditions.

Figure 2:
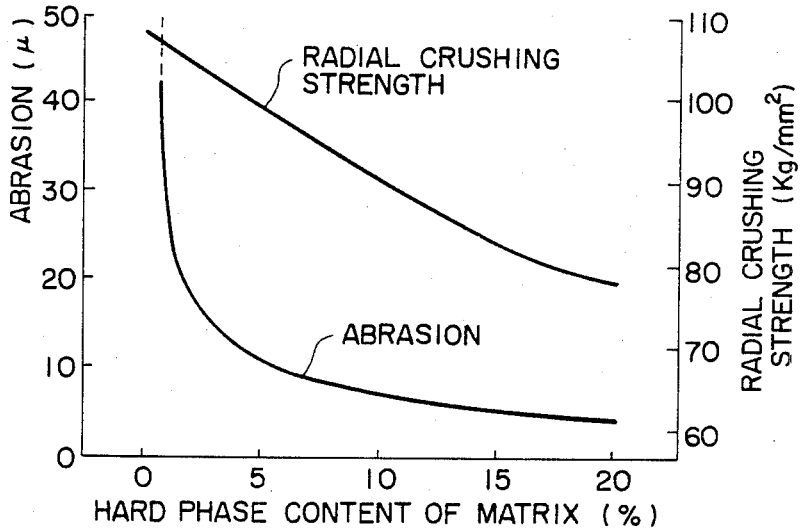

The graph of FIG. 2 reveals an influence of the hard phase contents in the matrix on the radial crushing strength and wear resistance, and shows that an increase in the amount of the hard phase causes a reduction in the abrasion wear, but gives rise to a lowering of the strength. In general, since the valve seat is merely locked in a groove in a cylinder head by press or cooling fitting, there is a possibility that it disengage therefrom when the strength is insufficient. Accordingly, the amount of the hard phase added is required to be at least 3% in view of wearing and at most 15% in view of strength.

Figure 3:
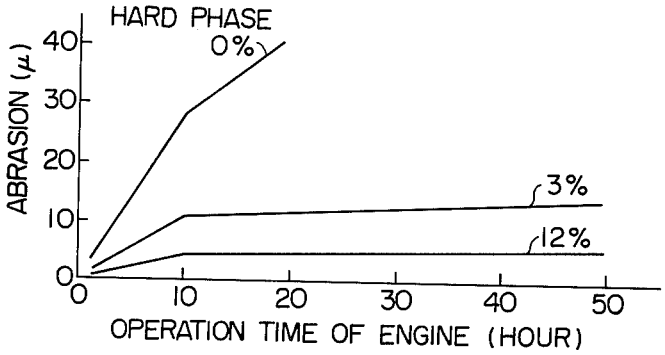

As shown in FIG. 3, the sample containing 3% of the hard phase merely shows an acceptable abrasion loss and is available even under the testing conditions where the hard phase-free matrix is worn away to a considerable extent. This is also demonstrated by the results of durability bench testing. It should be noted that as the amount of the hard phase increases up to 15%, there is a decrease in the abrasion wear; however, use of the hard phase in amounts exceeding 15% offers no advantage of significance in view of wearing.

To make clear the correlation between the matrix material and the presence of the hard phase, the samples free from and containing the hard phase C in a 10% amount were prepared from the alloying base A, the alloying base B and a mixture of equal amounts of A and B. For comparison, the results are set fourth in the following table.

TABLE 1

| Sample No. | Proportion of Matrix and Phase C | | | Abrasion Loss (μm) and Reduction of wearing due to Hard phase (%) | |
|---|---|---|---|---|---|
| | A | B | C | | |
| 10 | 100 | — | — | 45 μm | — |
| 11 | 90 | — | 10 | 30 | 33% |
| 20 | — | 100 | — | 25 | — |
| 21 | — | 90 | 10 | 20 | 20% |
| 30 | 50 | 50 | — | 10 | — |
| 31 | 45 | 45 | 10 | 2 | 80% |

Reduction of wearing = $100 \times (N_0 - N_1)N_0$

From the foregoing table it follows that the addition of the hard phase to the system A+B excels the addition thereof to the alloy A or B alone in the absolute value for abrasion wear, the degree of the action obtained and the rate of increasing the abrasion loss of the matrix.

Referring now to the ratio of the alloying base A to B in the matrix, it should first be noted that the wear resistance of the former per se is inferior to that of the latter per se. Let it be supposed that the alloying base A is added to the base B. The abrasion wear of the resulting system A+B begins to drop where the amount of A added exceeds 25%, reaches a minimum value when it ranges from 40 to 60%, and increases again when it is upwards of 60%. At more than 75%, the wear resistance of the system A+B is lower than that of the base B alone. This is why one of both alloying bases amounts to 25 to 75% of the matrix, and the other occupies to the remainder. While the addition of the hard phase C has been described, it will be understood that a similar action is obtained even if the phase C is partly or completely replaced by the hard phase D.

Figure 4:
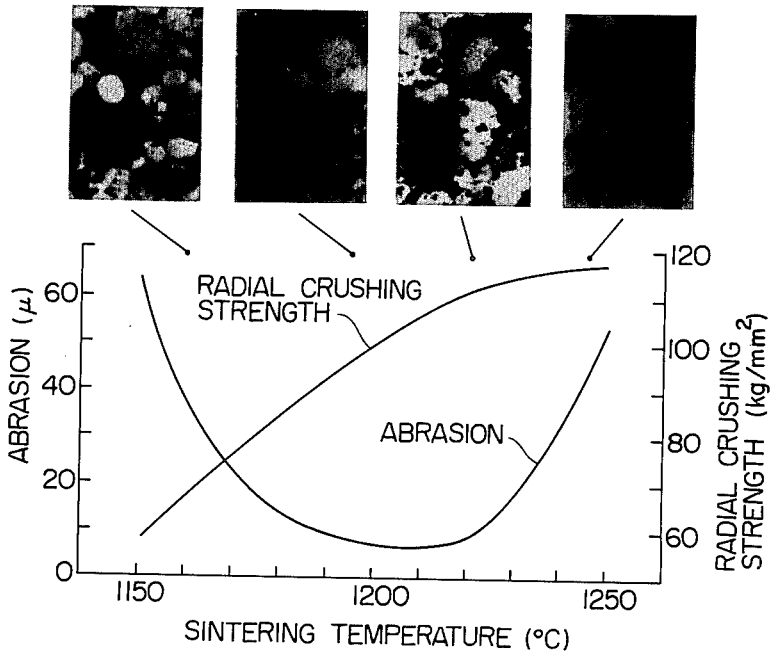

The graph and micrographs attached hereto as FIG. 4 indicate that the relationship between the temperatures applied in sintering of the alloys according to the present invention and the wear resistance, radial crushing strength and metallic structure of the resulting sintered material. From a comprehensive examination of these factors, it is found that the sintering temperature is preferably on the order of 1200° C.±20° C.

In order to help the sintered alloy of the present invention show a lubricating action on a solid body or mass, the pores thereof are impregnated with a given amount of lead in a molten state. The resultant product is best suitable for use in the case where the operating condition imposed an internal combustion engine are very severe.

As mentioned in the foregoing, the valve seat is now required to endure more vigorous conditions prevailing in internal combustion engines, in other words, to possess an optimum of shock absorbing—and heat-corrosion—and wear-resistant characteristics.

According to this aspect of the present invention, there is provided an ferro-sintered alloy comprising a shock absorbing perlite matrix phase in which are dispersed a phase A rich in the heat- and corrosion-resistance and phase B rich in the wear resistance with respect to low speed sliding movement.

Referring now to the composition of the phase A, it was basically selected from austenite stainless steel materials from a viewpoint of the characteristics which it was required to possess, and was modified in the conventional manner, if required. The composition of the phase A is given in Table 1 together with that of SUS 316 Jl for the purpose of comparison. In a word, the composition of the phase A is modified such that the work-hardening feature and strength are improved by the removal of Cr from the composition of SUS 316 Jl, the creep-resistance is enhenced by the addition of W thereto, and the resistance to acids and corrosion and the precipitation hardening properties are increased to a higher degree by the use of increased amounts of Mo and Cu.

TABLE 2

| Alloying Components | SUS 316 J1 (in weight %) | Desired Composition of Phase A (in weight %) | Composition of Alloying Powders for Phase A (in weight %) |
|---|---|---|---|
| Cr | 17~19 | 9~20 | 10~20 |
| Ni | 10~14 | 6~15 | 8~20 |
| Mo | 1.2~2.8 | 1.5~9.5 | 2~10 |
| W | — | 1.5~9.5 | 2~10 |
| Cu | 1.0~2.5 | 0.7~4.5 | — |
| Fe | The remainder | The remainder | The remainder |

The chromium in the composition of the phase A enhances the resistance to oxidation and abrasion; however, it has only a little influence in an amount of less than 9%, whereas it renders the phase fragile in an amount exceeding 20%. The nickel, together with Cr, upgrades the oxidation resistance and strength of the phase A, maintains the stability and toughness of austenite and exhibits high compatibility with respect to the associated materials. However, less effect is obtained if the amount of nickel is less than 6%. The addition of more than 15% of nickel is costly and did not produce such effects as expected. Both Mo and W contribute toward improvements in hardness and wear resistance at elevated temperatures. Less effect is also obtained if they are added in amounts of below 1.5%. The addition of more than 9.5% of them results in a lowering of toughness. The copper added contributes, together with the molybdenum, to improvement in the resistance to acids and corrosion and the appearance of precipitating hardening. If the copper is added in an amount of below 0.7%, then the effects obtained are only a little. In an amount exceeding 4.5%, the copper offers no advantages.

In order to permit formation of the phase A in a matrix, use may be made of the method comprising incorporation of a base alloying powder having the composition substantially identical with that as given in the right column of Table 2 but may slightly deviates therefrom in consideration of diffusion during sintering. It should be noted that the reason why the copper is freed from the alloying powder is that the perlite solid solution is upgraded by separate addition of copper.

To allow this phase A to produce the desired effect, it is required that it be present in the matrix in an amount of more than 10%. A lower amount of the phase A leads to a lowering of the durability of the resulting valve seat. The presence of the phase A in an amount of more than 50% offers no particular problem as such; however, it is virtually impossible to compact a matrix containing more than 50% of the phase A, since the alloying powder for the phase A are poor in compactability characteristics. This is why the amount of the phase A is restricted to a range of 10 to 50%.

Referring to phase B, use is made of four types of phases having the compositions as shown in Table 3.

TABLE 3

| | Alloying Components | Composition of Phase B (in weight %) | Composition of Alloying Powders (in weight %) |
|---|---|---|---|
| B1 | Mo | 50~70 | 55~70 |
| | Fe | The remainder | The remainder |
| B2 | Cr | 50~70 | 55~70 |
| | Fe | The remainder | The remainder |
| B3 | Fe | 45~60 | 50~60 |
| | Mo | 33~36 | 33~37 |
| | Si | The remainder | The remainder |
| B4 | Co | 45~60 | 50~60 |
| | Mo | 33~36 | 33~37 |
| | Si | The remainder | The remainder |

For the convenience of illustration, the four types of phases are designated by B1–B4, respectively. B1 and B2 are ferromolybdenum and ferrochromium, and B4 a commercially ternary intermetallic compound B3 is a ternary intermetallic compound developed in the light of B4.

To permit these phases B to exhibit the desired effect, it is required that they be present in amounts ranging from 2 to 15% in a matrix. Lower amounts of them causes that the wear resistance demanded for valve seats is insufficient, while higher amount of them make the material fragile. Thus, lower and higher amounts of the phases B are inappropriate. In should be noted that the compositions of the alloying powders for the phases B are determined in consideration of diffusion during sintering.

In carrying out the present invention, a mixture of powders containing given amounts of carbon and copper blended with iron powder is used as a raw material in addition to the alloying powders for the phases A and B.

Referring first to carbon, it is added in the form of carbon powders in a amount of 0.7 to 1.5%. A major portion of the carbon is consumed to provide toughness to a matrix thereby converting it into a perlite structure, and the remaining portion takes into a solid solution with the phases A and B and provides fine carbides. However, if the amount of carbon added is on one hand less than 0.7%, hardening of the material becomes insufficient. If the amount exceeds 1.5% on the other hand, marked embrittlement of the material takes place. As described in the foregoing, the copper is independently added in an amount of 0.5 to 3% and takes into a solid solution mainly with the matrix and phase A to enhance the strength thereof. If the amount of copper is on one hand less than 0.5%, no appreciable effect is obtained. If the amount exceeds 3%, on the other hand, the material is rendered porous, thus resulting in a decrease in the strength thereof.

EXAMPLE

In this examples, % is given in weight. 73% of iron powders, 1% of copper powders, 1% of graphite powders, 20% of alloying powders having the composition of Fe/15Cr/10Ni/5Mo/5W and a particle size of 80 or less meshes and 5% of low-carbon ferromolybdenum powders having a particle size of 150 or less meshes were amply mixed together with the addition of zinc stearate in an amount of 0.5 relative to the total weight. The mixture was compacted into a given ring shape, and was then sintered at 1130° C. for 30 minutes in an atmosphere of cracked ammonia to prepare a sintered product having a sintering density of 6.74 g/cm$^3$ and a radial crushing strength of 80 kg/mm$^2$.

Figure 5:
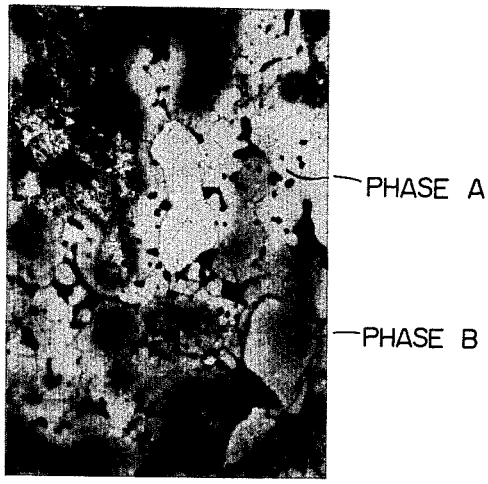
FIGS. 5 and 6 are micrographs the structure and composition of the sintered alloy according to the present invention.

As shown in a micrograph of FIG. 5, the sintered product was found to have a metallic structure comprising the phases A and B dispersed in the perlite matrix. The matrix and phases A and B were found to have a microVickers hardness of 260, 430 and 1300, respectively.

The results of composition analysis with a X-ray analyzer are tabulated in Table 4 together with the composition and proportion of starting powders.

TABLE 4

(in weight %)

| Composition and Proportion of Starting Materials | | | Composition of Phases Formed |
|---|---|---|---|
| Iron powders | 73% | Matrix | Fe 96.7% |
| Copper Powders | 1% | | Cu 1.2 |
| Graphite Powders | 1% | | C 0.8 |
| | | | Cr 0.1 |
| | | | Ni 0.7 |
| | | | Mo 0.5 |
| 65 Fe | 20% | Phase A | Fe 66.0% |
| 15 Cr | | | Cr 14.2 |
| 10 Ni | | | Ni 7.6 |
| 5 Mo | | | Mo 4.6 |
| 5 W | | | W 5.1 |
| | | | Cu 1.0 |
| | | | C 1.5 |
| 35 Fe | 5% | Phase B | Fe 36.2% |
| 65 Mo | | | Mo 61.7 |
| | | | C 2.1 |

As evident from Table 4, a major portion of Cu added in the powder form diffuses into the matrix and a part thereof diffuses into the phase A. About 60% of C added in the form of graphite powders pass diffusedly into the matrix, about 30% pass into the phase A, and the remainder passes into the phase B. On the other hand, parts of Cr, Ni and Mo contained in the alloying powders for the phases A and B migrate diffusedly into the matrix.

The occurrence and degree of diffusion of the sintering. Consequently, the range of the composition of Fe defined in the phases A and B according to this aspect may include C entrained from the other phase. It is also permissible that the matrix of the perlite structure has 1.5% or less of Cr, 1% or less of Ni or 1.5% or less of Mo or Co diffused therein.

Since the diffusion of the ingredients added serves to reinforce the respective phases, excessive diffusion offers no problem as such. Under the sintering conditions causing excessive diffusion of the ingredients, however, losses of the hard phase B occurs since it takes into solution. As a result, a problem arises in connection with the characteristic features of the present invention. In the present invention, it is thus desired that sintering be effected at temperatures which are rather higher but gives rise to no loss of the phase as a result of it taking into solution. Such temperatures are determined depending upon the kind of the phase B applied. In the case of B1 and B2 in Table 3, the more the carbon content, the lower the melting point will be. In particular, the starting materials having a low carbon content can be sintered at temperatures up to 1200° C.; however, the starting materials having a lower carbon content as specified by JIS is merely sintered at temperatures of at most 1150° C. In this respect, B3 and B4 are rather advantageous since the upper limit for sintering is 1220° C. In consideration of these factors, a proper range of sintering temperatures is between 1100° C. and 1200° C. If sintering takes place within such a range of temperatures, the diffusion of the ingredients added proceeds only within the aforesaid range.

Figure 6:
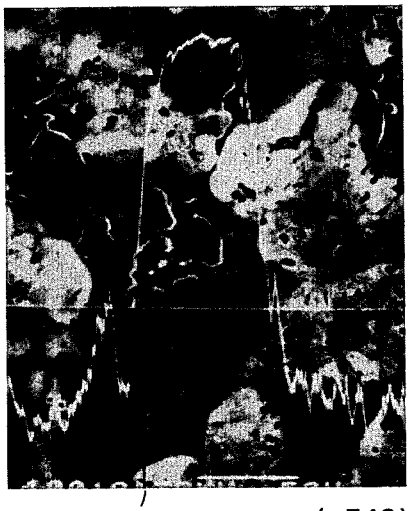

A close examination of the phase boundaries indicates that their composition varies successively in an area of 15 to 30$\mu$. This means that sufficient diffusion takes place in the boundaries so that firm bounds are obtained therebetween. As an example, a micrograph showing the results of X-ray line analysis of the phase A and the perlite matrix located on both its sides is given as FIG. 6.

Figure 7:
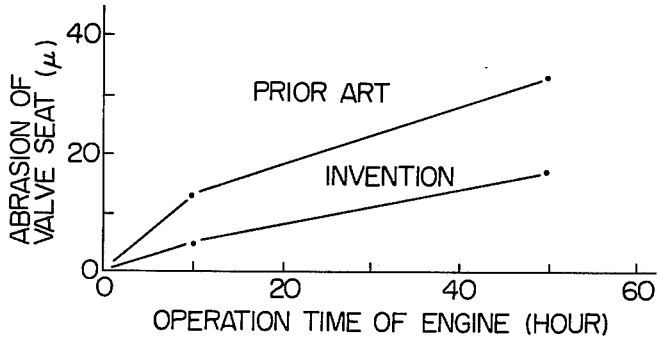
FIG. 7 is a graphical view showing the wear resistance of valve seats for internal combustion engines, said valve seats being made according to the present invention and the prior art.

Referring to FIG. 7, there are plotted the results of the bench durability testing of the valve seats made of the sintered alloy of the present invention and of a conventional sintered alloy consisting of Fe-1.2 Mo-1.2 Ni-5.2 Co-0.8C and impregnated with lead using a four-cylinder engine of 1400 CC. This graph shows that the abrasion loss of the valve seat according to the present invention decreases to about 60% as compared with the conventional seat.

A similar durability test was carried out on the remaining B phases. As a result, it has been found that B4 is slightly, better than or equivalent to B1, and B2 and B3 are identical with each other but somewhat inferior to B1 and B4. However, B2 and B3 are superior to the prior art seat.

We claim:

1. A ferro-sintered alloy having wear resistance at elevated temperatures, comprising a matrix in which 25 to 75 weight % of an alloying base A of the following composition is irregularly dispersed with 75 to 25 weight % of an alloying base B of the following composition, said matrix having 3 to 15 weight % of at least one of the following hard phases C and D dispersed therein:

| Base A | | | Base B | | |
|---|---|---|---|---|---|
| Cr | 2~4% | (by weight) | Co | 5.5~7.5% | (by weight) |
| Mo | 0.2~0.4% | (by weight) | Ni | 0.5~3% | (by weight) |
| V | 0.2~0.4% | (by weight) | Mo | 0.5~3% | (by weight) |
| C | 0.6~1.2% | (by weight) | C | 0.6~1.2% | (by weight) |
| Fe | the remainder | | Fe | the remainder | |

Hard phase C:
45~60% Co—33~36% Mo—and remainder Si Alloy (by weight)
Hard phase D:
45~60% Fe—33~36% Mo—and remainder Si Alloy (by weight)

2. A ferro-sintered alloy having wear resistance at elevated temperatures, comprising a matrix in which 25 to 75 weight % of an alloying base A of the following composition is irregularly dispersed with 75 to 25 weight % of an alloying base B of the following composition, said matrix having 3 to 15 weight % of at least one of the following hard phases C and D dispersed therein; and being impregnated in its pores with lead

| Base A | | | Base B | | |
|---|---|---|---|---|---|
| Cr | 2~4% | (by weight) | Co | 5.5~7.5% | (by weight) |
| Mo | 0.2~0.4% | (by weight) | Ni | 0.5~3% | (by weight) |
| V | 0.2~0.4% | (by weight) | Mo | 0.5~3% | (by weight) |
| C | 0.6~1.2% | (by weight) | C | 0.6~1.2% | (by weight) |
| Fe | the remainder | | Fe | the remainder | |

Hard phase C:
45~60% Co—33~36% Mo—and remainder Si Alloy (by weight)
Hard phase D:
45~60% Fe—33~36% Mo—and remainder Si Alloy (by weight)

* * * * *